United States Patent [19]

Wimmer

[11] Patent Number: 4,478,168

[45] Date of Patent: Oct. 23, 1984

[54] DOOR BRACE AND ALARM DEVICE

[76] Inventor: Robert C. Wimmer, 3337 SW. 7th St., Ocala, Fla. 32674

[21] Appl. No.: 401,230

[22] Filed: Jul. 23, 1982

[51] Int. Cl.[3] ..... G08D 13/08

[52] U.S. Cl. ..... 116/82; 116/86; 116/DIG. 44

[58] Field of Search ..... 116/82, 86, 87, 88, 116/89, 91, 8, 13, DIG. 44; 340/541, 546, 545

[56] References Cited

U.S. PATENT DOCUMENTS

| | | | |
|---|---|---|---|
| 847,975 | 3/1907 | Todd | 116/87 |
| 1,082,325 | 12/1913 | Head | 116/13 |
| 1,091,385 | 3/1914 | Philip | 116/13 |
| 1,346,768 | 7/1920 | Ritchie | 116/13 |
| 1,467,363 | 9/1923 | Fairall | 116/13 |
| 2,870,281 | 1/1959 | Mitchell | 340/546 |
| 3,797,005 | 3/1974 | Schwarz | 340/545 |
| 3,804,053 | 4/1974 | Gray | 116/86 |

FOREIGN PATENT DOCUMENTS

| | | | |
|---|---|---|---|
| 686137 | 1/1953 | United Kingdom | 116/82 |
| 2029061 | 3/1980 | United Kingdom | 340/546 |

*Primary Examiner*—Charles Frankfort
*Assistant Examiner*—Denis E. Corr
*Attorney, Agent, or Firm*—Malin, Haley & McHale

[57] ABSTRACT

A door brace alarm apparatus for resisting movement of a door and for providing a sound alarm when such movement of the door is attempted. Two slideably connected shaft members are adjustable for angular placement between the door knob and the floor. A bifurcated yoke and a floor support retain the door brace alarm in position by contact with the door knob and floor. A pivotally mounted alarm housing connected to one of the shaft members houses an alarm retainer which provides for extension adjustment by threaded cooperation with a cavity in the alarm housing. The alarm retainer houses the sound generator and adjusts to position the sound generator in juxtaposition with the door so that it will emit an alarm sound upon impact by the door.

4 Claims, 2 Drawing Figures

DOOR BRACE AND ALARM DEVICE

BACKGROUND OF THE INVENTION

This invention relates to a new and improved combination door brace and alarm device to rigidly resist movement of the door and to provide alarm of such movement.

Various alarm and locking systems for doors involves elaborate locks and usually electronical alarm systems to resist entry and to raise alarm of such attempts. Such systems are static and cannot be utilized on other doors with extensive installation. This simple and mobile apparatus both resists entry and provides a piercing alarm without reliance on external power systems. This apparatus may be collapsed for storage and transport. The alarm sound is provided by the moving door impacting against a compressed air horn.

The U.S. patent to Gray, U.S. Pat. No. 3,804,053, proposes a combination of a door stop and alarm which utilizes a container of pressurized gas and a sound generator to serve both the role of the stop and the alarm. As set forth in the specifications and claim 1 of Gray, reliance is placed upon the sound generator and container to limit movement of the door. Due to the generally reduced size of the sound generator and its container its ability to resist a forceful movement of the door is questionable. The instant invention is an improvement over Gray in that it has a shaft dedicated to resisting movement of the door. The instant invention also does not require any support means which are not an integral part to attach it to the door which permits the instant invention to be utilized on any door immediately. The instant invention may also be adjusted to allow partial movement of the door before resistance is applied and the warning sound set off.

SUMMARY OF THE INVENTION

The present invention relates to a new and improved door brace alarm. A rigid bracing shaft is comprised of two or more rigid shaft members slideably interconnected for variable adjustment in length. An upper shaft member will provide for contact with the door knob while a lower shaft member contacts the floor. An inner shaft member is inserted parallel into an outer shaft member to slideably cooperate so that the two units may be slideably extended or contracted.

The hollow, outer shaft member is provided a plurality of holes which define a plurality of apertures on the surface of the shaft member generally equally spaced in a line parallel to the longitudinal axis of the shaft. The inner shaft may have a tapered tip for insertion into the hollow, outer shaft member and a biased retaining pin for placement into any of the apertures to restrain longitudinal movement between the two shaft members and provide a rigid, bracing shaft for connection with the door knob and floor. By pressing on the retaining pin on the inner shaft member it is displaced out of the aperture on the outer shaft and allows the two shaft members to extend or contract to adjust the length of the bracing shaft. The retaining pin occupies another aperture when pressure is exerted by the biasing mechanism. The plurality of apertures allows for variable adjustment of the shaft members so that the brace shaft can be adopted to accommodate various door knob heights and to vary the position of the alarm housing adjacent to the door. The length of the shaft can be adjusted so that initial opening of the door is mildly resisted and no warning sound is emitted. At a preselected opening distance the full resistance of the shaft will come to bear against the movement of the door and then or shortly thereafter the door will impact the sound generator. This will allow the door to be partially opened to look out perhaps without compromising the bracing and alarm features of the device. The use of light-weight, hollow, shaft members will provide for a transportable device.

A bifurcated yoke is attached to the distal end of the upper shaft member and straddles the door knob to retain the bracing shaft in contact with the door. The yoke is attached at an angle to the upper shaft member so that the shaft may be positioned at an angle away from the door to provide lateral resistance to the door if moved toward the bracing shaft.

A floor support is attached to the distal end of the lower shaft member for contact with floor. A non-skid pad may be placed between the floor and floor support to increase non-skid contact with the floor. An alarm housing is pivotal mounted to one of the bracing shaft members to allow rotational extension toward the door and to house the sound generator.

The alarm housing has two parallel bifurcated flanges which are pivotally mounted to a bracing shaft member. To position the door brace alarm for operation the alarm housing rotates downward toward the door and is positioned generally horizontal while the bracing shaft is positioned at an angle from the door knob to the floor. A structural stop on the alarm housing impinges against the surface of the shaft member to retain the alarm housing in a generally horizontal position. The alarm housing is rotated upward to retract it and two biased housing retainer protrusions will engage the shaft member to retain the alarm housing in a storage position generally parallel to the shaft member. Retraction of the alarm housing and compression of the shaft members will facilitate storage and transportation of the device.

The alarm housing has a threaded cavity for screw-in insertion of an alarm retainer with corresponding threads. The cannister retainer may be rotated to adjustably protrude from or recede into the alarm housing cavity. In this manner the sound generator which is housed in a cavity of the alarm retainer may be positioned adjacent to the door so that movement of the door will be resisted by the bracing shaft to prevent opening and the door after traveling a specified distance will impact the compressed air sound generator to emit a piercing sound to warn of movement of the door. The canister retainer may be adjusted so that this travel distance may be varied according to the requirements of the situation. The shorter the distance the greater the sensitivity to movement. A greater distance will still resist movement without inadvertent alarm emissions. This device may be used solely in the bracing embodiment with the alarm housing in the storage position. The shaft members may be adjusted to their shortest position and the alarm housing retracted for storage and transport.

The instant invention may be used to brace your common interior door, either inward or outward opening. Due to its angular bracing capability it may be used with any sliding or swinging door or closure device.

It is the primary objective of the instant invention to provide a door brace and alarm to rigidily resist the unauthorized opening of a door and to simultaneously provide a warning sound of such movement.

It is another objective of the instant invention to provide an adjustable door brace and alarm to permit a partial opening of a door and to provide for increased resistance and a warning sound after the door has traveled a preselected distance.

It is yet another objective of the instant invention to provide a door brace and alarm which is adjustable to various lengths to accommode different doors.

It is another objective of the instant invention to provide a door brace and alarm which may be utilized without any prior preparation or installation.

It is still another objective of the instant invention to provide a door brace and alarm which is lightweight, collapsible, transportable and economical to construct and yet strong enough to resist unauthorized opening of a door.

In accordance with these and other objects which will be apparent hereinafter, the instant invention will now be described with particular reference to the accompanying drawings.

BRIEF DESCRIPTION OF THE DRAWING FIGURES

DESCRIPTION OF THE PREFERRED EMBODIMENT

Figure 1:
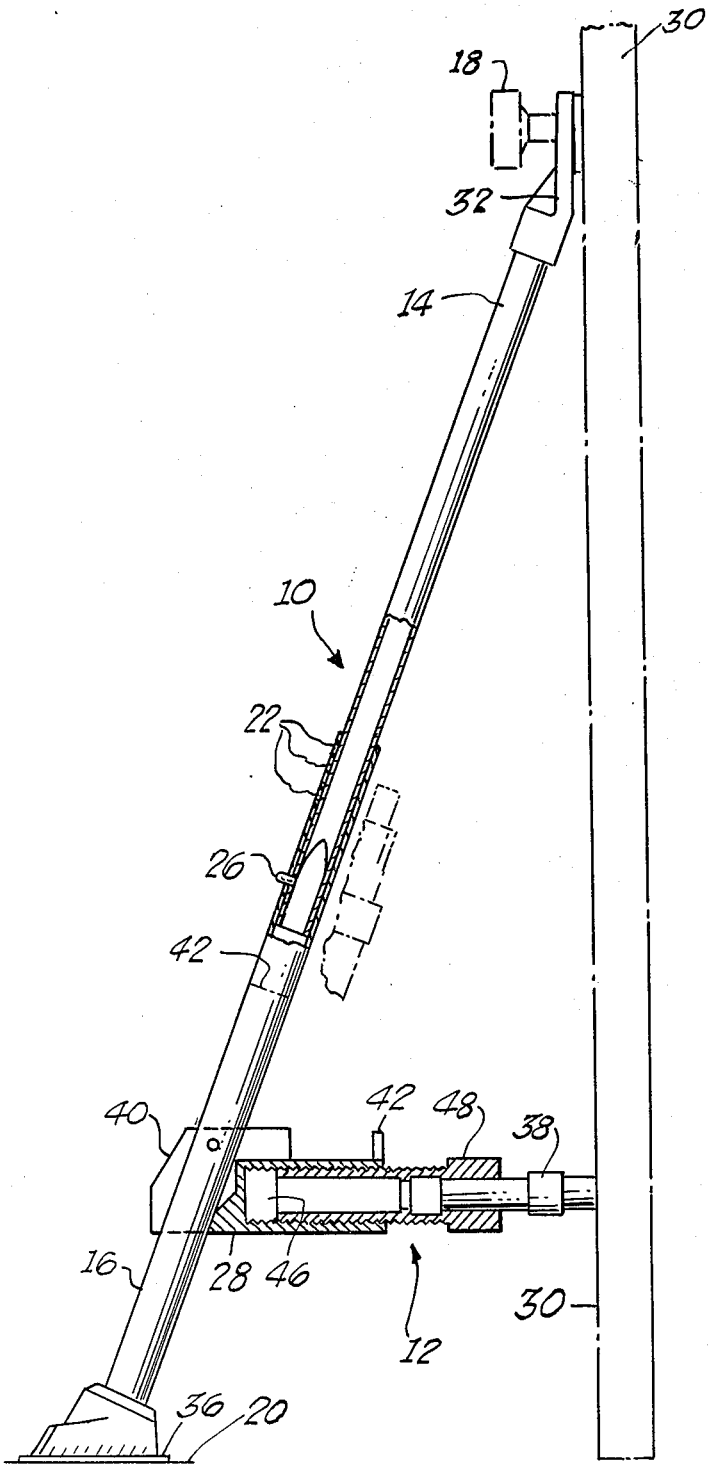
FIG. 1 is a side elevational view partly in section of the invention.
Figure 2:
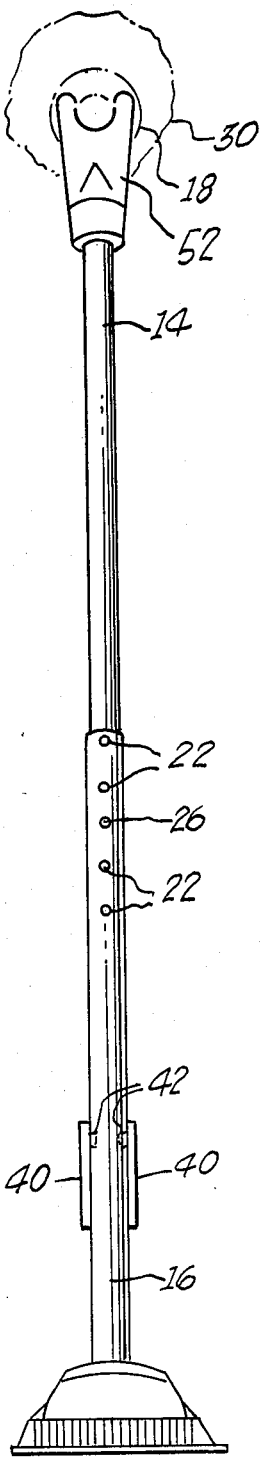
FIG. 2 is a front elevational view of the invention.

Referring now in detail to the drawings and to FIG. 1, there is shown a side elevational view with a partial cross section of the door brace alarm, generally designated as numeral 10, in an extended operation position. A rigid bracing shaft 12 is comprised of two or more rigid shaft members 14 and 16 slideably interconnected for variable adjustment in length. An upper shaft member 14 will provide for contact with the door knob 18 while a lower shaft member 16 contacts the floor 20. At FIG. 2 is shown a shaft member 14 inserted parallel into a hollow, outer shaft member 16 to slideably cooperate so that the two units may be slideably extended or contracted.

The hollow, outer shaft member 16 is provided a plurality of holes which define a plurality of apertures 22 on the surface of the shaft member 16 generally equally spaced in a line parallel to the longitudinal axis of the shaft 12. The inner shaft 14 may have a tapered shaft tip for insertion into the hollow, outer shaft member 16 and a biased retaining pin 26 for placement into any of the apertures 22 to restrain longitudinal movement between the two shaft members 14 and 16 and provide a rigid, bracing shaft 12 for connection with the door knob 18 and floor 20. By pressing inward on the retaining pin 26 on the inner shaft member 14 it is displaced out of the aperture 22 on the outer shaft member 16 and allows the two shaft members 14 and 16 to extend or contract to adjust the length of the bracing shaft 12. The retaining pin 26 occupies another aperture 22 when pressure is exerted by the biasing mechanism. The plurality of apertures 22 allows for variable adjustment of the shaft members 14 and 16 so that the brace shaft 12 can be adopted to accommodate various door knob heights and to position the alarm housing 28 adjacent to the door 30.

A bifurcated yoke 32 is attached to the distal end of the upper shaft member 14 and straddles the door knob 18 to retain the bracing shaft 12 in contact with the door 30. The yoke 32 is attached at an angle to the upper shaft member 14 so that the shaft 12 may be positioned at an angle away from the door 30 to provide lateral resistance to the door 30 if moved toward the door brace alarm 10.

A floor support 34 is attached to the distal end of the lower shaft member 16 for contact with floor 20. A non-skid pad 36 may be placed between the floor 20 and floor support 34 to increase non-skid contact with the floor 20. An alarm housing 28 is pivotal mounted to one of the bracing shaft members to allow rotational extension toward the door and to house the alarm canister 38.

The alarm housing 28 has two parallel bifurcated flanges 40 which are pivotally mounted to a bracing shaft member. To position the door brace alarm 10 for operation the alarm housing 28 rotates downward toward the door 30 and is positioned generally horizontal while the bracing shaft 12 is positioned at an angle from the door knob 18 to the floor 20. A portion of the alarm housing 28 abuts against the surface of the shaft member to retain the alarm housing 28 in a generally horizontal position. The alarm housing 28 is rotated upward to retract it and two biased housing retainer arms 42 will engage the shaft member to retain the alarm housing 28 in a storage position 44 adjacent to the shaft member with the alarm canister 38 generally parallel to the shaft member.

The alarm housing 28 has a threaded cavity 46 for screw-in insertion of a canister retainer 48 with corresponding threads. The canister retainer 48 may be rotated to adjustably protrude from or recede into the alarm housing cavity 46. In this manner the alarm canister 48 which is housed in cavity 46 of the canister retainer 48 may be positioned adjacent to the door 30 so that movement of the door 30 will be resisted by the bracing shaft 12 to prevent opening and the door 30 after traveling a specified distance will impact the compressed air sound alarm canister 48 to emit a piercing sound to warn of movement of the door 30. The canister retainer 48 may be adjusted so that this travel distance may be varied according to the requirements of the situation. The shorter the distance the greater the sensitivity to movement. A greater distance will still resist movement without inadvertent alarm emissions. This device may be used solely in the bracing embodiment with the alarm housing 28 in the storage position. The shaft members 14 and 16 may be adjusted to their shortest position and the alarm housing 28 retracted for storage and transport.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A door brace alarm apparatus, comprising:

an alarm means for producing a warning sound when the door is moved relative to the generally horizontal floor;

a shaft means positionable at an angle from a generally vertical door to a generally horizontal floor for providing resistance to attempted movement of said door and for providing support for said alarm means, said shaft means having two ends, said shaft means including a horizontal connection means connected to said ends for connection to said door and said floor;

said alarm means including a triggering means for triggering said alarm means;

said alarm means connected to said shaft means to position said triggering means for producing a warning sound when the door is moved relative to the generally horizontal floor in opposition to the resistance supplied by said shaft means;

said alarm means comprise an alarm housing means and a sound emitting means;

said alarm housing means connected to said shaft means for providing support to the sound emitting means in juxtaposition to said door;

said sound emitting means connected to said alarm housing means in juxtaposition to said door for providing a sound upon movement of said door in opposition to the resistance provided by said shaft means;

said alarm houing means includes an adjustable alarm retainer means and a shaft retention means;

said alarm housing means providing threaded cooperation with said alarm retainer means for generally lateral, horizontal adjustment and support of said sound emitting means in juxtaposition with said door;

said alarm housing means rotatably connected to said shaft means, said alarm housing means impinges against said shaft means in a generally horizontal position;

said alarm retainer means connected to said alarm housing means in threaded cooperation providing support and generally lateral, horizontal adjustment for said sound emitting means in juxtaposition with said door, said alarm retainer means connected to said sound emitting means;

said shaft retention means connected to said alarm housing means for connecting to and retaining said alarm housing means in a storage position generally parallel to said shaft means.

2. An apparatus as set forth in claim 1, wherein:

said alarm housing means is an elongated housing rotatably connected at one end to said shaft means, said housing having a structural stop impinging against said shaft means limiting the downward rotation of said housing to a position generally horizontal, said housing having a distal end portion defining an elongated, cylindrical, internally threaded cavity, said cavity defines an aperture at the distal end of said housing;

said retainer means is an externally threaded, hollow, open end, elongated, cylinder insertable into said cavity in threaded cooperation, said sound emitting means insertable into said hollow cylinder, said hollow cylinder being adjustable into and out of said cavity by threaded cooperation upon rotation of said hollow cylinder;

said shaft retention means is a pair of biased protrusions connected to said housing, said protrusions engage and retain said shaft means by an encompassing, biased pinching action.

3. An apparatus as set forth in claims 1 or 2, wherein:

said sound emitting means is a well known gas-operated, impact initiated sound generator.

4. An apparatus as set forth in claims 1 or 2, including:

a well known, non-slip, gripping, rubberized floor pad insertable between said shaft means and said floor.

* * * * *